United States Patent [19]

Sugiyama

[11] Patent Number: 4,505,607

[45] Date of Patent: Mar. 19, 1985

[54] RETRACTABLE-TYPE COSMETIC CONTAINER WITH REMOVABLE BASE

[75] Inventor: Takashi Sugiyama, Kodaira, Japan

[73] Assignee: Yoshida Industry Co., Ltd., Tokyo, Japan

[21] Appl. No.: 535,531

[22] Filed: Sep. 26, 1983

Related U.S. Application Data

[63] Continuation of Ser. No. 345,529, Feb. 3, 1982, abandoned.

[30] Foreign Application Priority Data

Mar. 25, 1981 [JP] Japan ..... 56-40683[U]

[51] Int. Cl.[3] ..... A45D 40/06; A45D 40/16

[52] U.S. Cl. ..... 401/78; 401/70; 401/79; 401/98

[58] Field of Search ..... 401/68, 75, 77, 78, 401/98, 86, 87, DIG. 1, 69, 70, 79, 73

[56] References Cited

U.S. PATENT DOCUMENTS

| | | | |
|---|---|---|---|
| 2,461,790 | 2/1949 | Vaughn | 401/79 |
| 2,595,635 | 5/1952 | Braselton | 401/75 |
| 2,612,990 | 10/1952 | Braselton | 401/87 |
| 2,621,786 | 12/1952 | Schnack | 401/DIG. 1 |
| 2,964,172 | 12/1960 | Landen | 401/75 |
| 3,191,768 | 6/1965 | Davis | 401/69 X |
| 3,230,960 | 1/1966 | Moore et al. | 401/78 |
| 3,623,821 | 11/1971 | Gould | 401/86 |

FOREIGN PATENT DOCUMENTS

| | | | |
|---|---|---|---|
| 1118520 | 6/1956 | France | 401/98 |
| 1205370 | 2/1960 | France | 401/DIG. 1 |
| 1548336 | 10/1968 | France | 401/75 |
| 2393547 | 2/1979 | France | 401/68 |
| 1219926 | 1/1971 | United Kingdom | 401/75 |

*Primary Examiner*—Steven A. Bratlie

*Attorney, Agent, or Firm*—Wenderoth, Lind & Ponack

[57] ABSTRACT

A retractable-type cosmetic container includes a holder having a cosmetic projecting-retracting means and adapted to be mounted on a manipulating member provided separately from the holder, and a cap closure. An inner tube of the holder is provided at its lower end with an opening of angular shape within which a hollow projection of the manipulating member is detachably engaged for unitary rotation of the member and the inner tube.

3 Claims, 3 Drawing Figures

RETRACTABLE-TYPE COSMETIC CONTAINER WITH REMOVABLE BASE

This application is a continuation of now abandoned application Ser. No. 345,529, filed Feb. 3, 1982 now abandoned.

BACKGROUND OF THE INVENTION

This invention relates to retractable-type cosmetic containers for lipsticks or other soft solid cosmetic materials, and particularly relates to a container of the type in which a part thereof holding cosmetic materials is exchangeable.

A cosmetic container of the type set forth above has an advantage that even when the lipstick or other similar cosmetic material is used up, for example, the container except for the holding part can be utilized by replacing the old part with a new one having a full cosmetic material and therefore a customer is not impelled to purchase a whole new container. This kind of cosmetic container also enables the customer to use various lipsticks of different colors with a single container by preparing a desirable number of the holding parts and incorporating any of them into the container.

A cosmetic container of this kind is shown in Japanese Utility Model Publication No. 56-6007 in which a holder having a cosmetic projecting-retracting means is detachably mounted on a manipulating member. In such a container, however, since the manipulating member comprises three elements each having a helicoid groove, the structure of the manipulating member is complicated and high level accuracy is required in making such grooves and elements, which results in a relatively large cost of the container.

Accordingly, it is an object of the present invention to provide a cosmetic container of retractable type in which a holder having a cosmetic projecting-retracting means can be engaged with and disengaged from a manipulating member by quite simple action.

Another object of the present invention is to provide a cosmetic container of retractable type which is simple in structure and may be manufactured at relatively low cost.

A further object of the present invention is the provision of a retractable-type cosmetic container reliable in operation, and particularly reliable in projecting and retracting cosmetic material such as a lipstick by rotating a manipulating member.

SUMMARY OF THE INVENTION

A cosmetic container of retractable type according to the present invention comprises a cylindrical holder having an outer and inner sleeves or tubes and a carrier cup, a manipulating member adapted to be detachably connected to the holder, and a cap for closing the holder. The inner sleeve or tube is provided in its side wall with a pair of diametrically opposed slots and is rotatably mounted in the outer tube which, in turn, is provided at its inner wall with a pair of diametrically opposed helicoidal grooves. Mounted in the inner tube is the carrier cup adapted to support a cosmetic material for vertical movement relative to the inner tube by a pair of pins, each projecting from the side wall of the cup for engagement through the respective slot with the respective helicoidal groove. The outer sleeve of the holder is open at both ends, while the inner tube or sleeve is provided at its lower end with an opening of angular configuration. The manipulating member includes a hollow projection having an angular section corresponding to the opening, a side wall of the hollow projection being inwardly flexible whereby the projection is detachably engageable in the opening for simultaneous rotation of the manipulating member and the inner tube of the holder.

Preferably, the opening of the holder has a polygonal shape and the projection of the manipulating member has a corresponding polygonal section.

More preferably, the inner tube is integrally provided at its lower end with an end plate in which the opening is formed, the end plate having an inclined lower surface around the opening.

Further objects and features of the present invention will become apparent from following the detailed description of a preferred embodiment thereof when taken in conjunction with the accompanying drawings, in which:

DETAILED DESCRIPTION OF THE INVENTION

Figure 1:
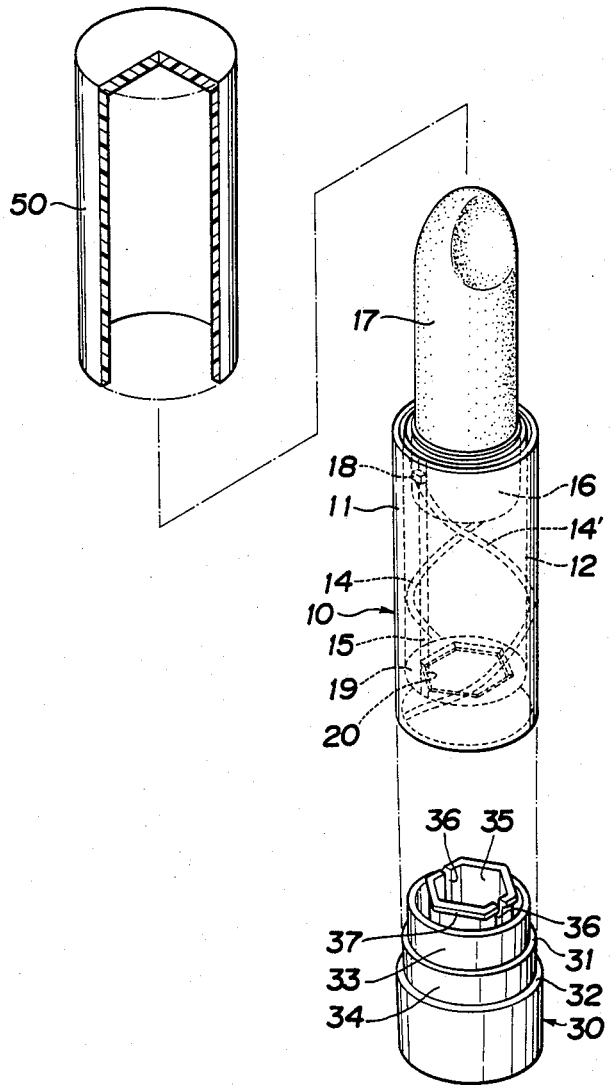
FIG. 1 is a perspective view showing a retractable-type cosmetic container according to a preferred embodiment of the present invention with three parts separated.

Referring now to FIG. 1 of the drawings, there is shown a retractable-type cosmetic container according to a preferred embodiment of the present invention. This cosmetic container comprises a cylindrical exchangeable holder 10 capable of being mounted on a manipulating member 30, and a cap closure 50.

Figure 2:
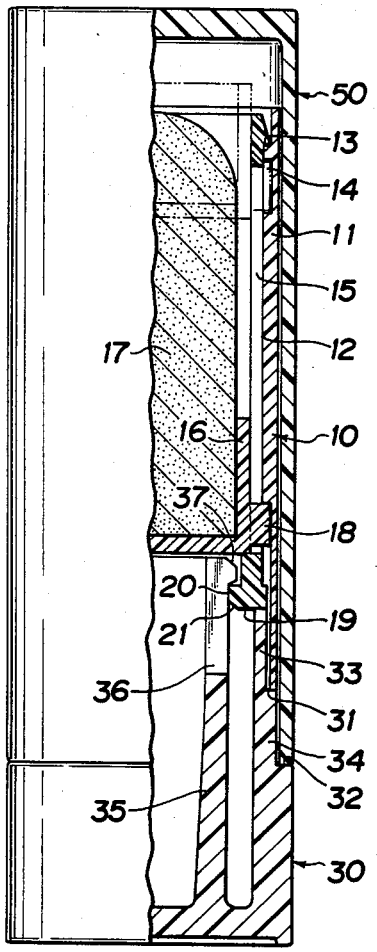
FIG. 2 is a partially sectioned elevational view of the container shown in FIG. 1 completely assembled.

The cylindrical holder 10 includes a cylindrical outer sleeve 11 with both ends open and an inner sleeve or tube 12 mounted for rotation in the outer sleeve 11 and axially retained by a shoulder 13 of the tube 12. The outer sleeve 11 is provided at an inner wall thereof with a pair of helicoidal grooves 14—14' which are diametrically opposed to each other, and the inner tube 12 is provided in a side wall thereof with two diametrically opposed slots 15 (only one slot 15 being shown) extending straight in the axial direction. Mounted for vertical movement in the inner tube 12 is a carrier cup 16 adapted to support a lipstick 17 or other soft solid cosmetic material. The carrier cup 16 has a pair of diametrically opposed pins 18 (only one pin 18 being shown) extending outwardly from an outer side wall of the cup 16 to engage in respective of the helicoidal grooves 14—14' of the outer sleeve 11 through the vertical slots 15 of the inner tube 12, as particularly shown in FIG. 2.

Figure 3:
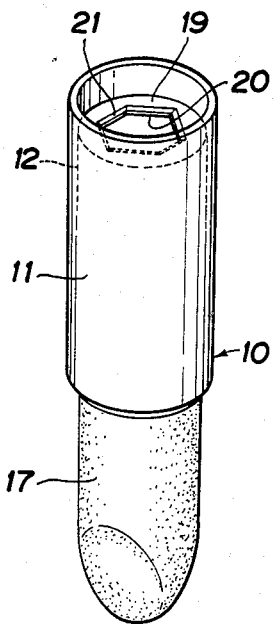
FIG. 3 is a perspective view showing a holder of the container shown in FIG. 1 but upside down.

The inner tube 12 has a length less than that of the outer sleeve 11 and is integrally formed at its lower end with an end plate 19 which is in turn provided with an opening 20 of any angular configuration as shown in FIG. 3. Preferably, the shape of the opening may be polygonal including at least five sides, and in the embodiment shown the opening 20 is shaped substantially as a regular hexagon. It is also preferable to incline lower surfaces 21 around the opening 20.

The manipulating member 30 has a cylindrical shape with a closed bottom and two axially separated steps 31 and 32 on a side wall of the member 30, thereby dividing the cylindrical member 30 into three parts having different diameters. An upper part 33 has an outer diameter substantially equal to an inner diameter of the outer sleeve 11, while an outer diameter of a middle part 34 is substantially equal to an inner diameter of the cap closure 50. Inside the cylindrical member 30 is integrally provided a hollow projection 35 extending upwardly from the bottom of the member 30 to a level beyond the upper level of the part 33. The hollow projection 35 should have an angularly shaped section and is adapted to be detachably engaged within the opening 20 of the inner tube 12. For this purpose, the hollow projection is so constructed that its side walls may be inwardly flexible and in this embodiment the projection 35 is provided in opposite side walls with a pair of diametrically opposed slits 36 which provide flexibility. Also, as in the case of the opening 20, the projection preferably has a polygonal section including at least five sides and in the illustrated embodiment it has a regular hexagonal section corresponding to the opening 20. Preferably, the projection 35 is provided at a top end thereof with inclined or slanted edges or surfaces 37 so that the projection can easily be inserted into the opening 20 during assembly.

The cap closure 50 is adapted to cover the outer sleeve 11 of the cylindrical holder 10 and to contact at its lower open end the step 32 of the manipulating member 30.

The entire assembly of the container may be made of plastic or other suitable material.

In assembling the present cosmetic container, the manipulating member 30 is inserted into the outer sleeve 11 of the holder 10 to engage the flexible projection 35 with the opening 20 of the inner tube 12. The inner tube 12 will then be rotatable in the outer sleeve 11 upon rotation of the manipulating member 30 due to the engagement between the opening 20 and the projection 35 both of which are shaped angularly. Thus, the rotation of the member 30 is accompanied by the rotation of the inner tube 12 which in turn causes the rotary and vertical movement of the carrier cup 16, the pins 18 of which are engaged through the slots 15 in the tube 12 with the helicoidal grooves 14—14' of the outer sleeve 11. The lipstick 17 or other cosmetic material will be let out for use and retracted for closure by the vertical movement of the cup 16.

After using up the lipstick 17 or other cosmetic material supported by the cup 16, for example, only the holder 10 need be replaced by a new holder having a full cosmetic. For the replacement, the manipulating member 30 may be pulled down whereby the flexible side wall of the hollow projection 35 is bent inwardly to be easily disengaged from the opening 20. The new holder will also be connected to the remaining member 30 simply by forcing the hollow projection 35 having the flexible side wall into the opening of the new holder.

Furthermore, in the preferred embodiment of the present invention, the angular opening 20 and the angular projection 35 are formed to be polygonal in configuration, more particularly to be regular hexagons, to be provided with the lower inclined surfaces 21 around the opening 20 and the top slanted edges 37 on the projection 35, respectively. Such a structure serves for the easy exchange of the holders 10. That is, even if the corners of the polygonal projection 35 are not correctly positioned relative to the corners of the opening 20 when assembly is started, the opening 20 together with the inner tube 12 would rotate due to the inclined surfaces 21 being pressed by the slanted edges 37 of the projection 35, thereby adjusting the positioning between the two elements. Thereafter the projection 35 is pushed into the opening 20 for engagement by snap action therewith, which is accompanied by a crack sound, and thus the holder 10 can be easily and surely mounted on the manipulating member 30.

This effect may also be substantially achieved without either the inclined lower surfaces 21 or the slanted edges 37.

As will be understood from the description above, the cylindrical holder 10 having the conventional retractable means can be mounted on the manipulating member 30 in a detachable manner by an easy and simple operation. Furthermore, since the rotation of the inner tube 12 with the manipulating member 30 is assured by the engagement in the angularly shaped opening 20 of the projection 35 of angular section, it is no longer necessary to provide a plurality of complicated helicoid grooves in the holder and/or manipulating member, whereby those parts become more simple and reliable.

Although the present invention has been described with reference to a preferred embodiment thereof, many modifications and alterations may be made within the spirit of the present invention.

What is claimed is:

1. A cosmetic container of the retractable type, said container comprising:

a cylindrical holder including an outer sleeve having open opposite ends and a side wall having formed in an inner surface thereof a pair of diametrically opposed helicoidal grooves, an inner tube rotatably positioned within said outer sleeve and including a side wall having extending therethrough a pair of diametrically opposed vertical slots having closed lower ends, said inner tube having a lower end plate having therethrough an opening of polygonal configuration including at least five sides, and a carrier cup positioned within said inner tube for supporting a cosmetic material and for vertical movement relative to said inner tube, said cup having extending therefrom a pair of pins, each said pin extending through a respective said slot in said inner tube and engaging in a respective said helicoidal groove in said outer sleeve;

a manipulating member adapted to be detachably connected to said holder and including a hollow projection having a polygonal cross section corresponding in configuration to the shape of said opening, said projection including side walls and an outwardly extending flange formed at an upper end of said side walls, said flange being engagable by snap action with an upper surface of said end plate for preventing said manipulating member from slipping off said holder, said side walls and said flange having therein vertically extending slits, thereby providing inward flexibility to said projection side walls;

both a lower surface of said end plate surrounding said opening and an upper portion of said flange having inclined surfaces forming means for enabling said projection to be inserted into said opening without the necessity of first adjusting the positions of the corners of said projection to align with the positions of the corners of said opening;

said manipulating member being separable from said holder simply by pulling said manipulating member and said holder apart; and a cap for fitting over said holder and onto said manipulating member for closing said holder.

2. A container as claimed in claim 1, wherein said manipulating member includes a bottom and a generally cylindrical outer wall extending from said bottom and having an upper end, and said projection extends from said bottom beyond said upper end of said outer wall.

3. A container as claimed in claim 2, wherein said outer wall includes two axially spaced steps dividing said outer wall into three axially spaced portions, said outer sleeve being mounted about an upper said portion, and said cap being mounted about a middle said portion.

* * * * *